US010472780B1

(12) United States Patent
Wilson et al.

(10) Patent No.: US 10,472,780 B1
(45) Date of Patent: Nov. 12, 2019

(54) SHIFTABLE MOLD

(71) Applicant: Wirtgen GmbH, Windhagen (DE)

(72) Inventors: Milton Wilson, Mansfield, TX (US); Nicholas Maupin, Brentwood, TN (US); Michael Engels, Obererbach (DE)

(73) Assignee: Wirtgen GmbH (DE)

( * ) Notice: Subject to any disclaimer, the term of this patent is extended or adjusted under 35 U.S.C. 154(b) by 0 days.

(21) Appl. No.: 16/009,375

(22) Filed: Jun. 15, 2018

(51) Int. Cl.
*E01C 19/00* (2006.01)
*E01C 19/48* (2006.01)
*E01C 19/40* (2006.01)

(52) U.S. Cl.
CPC ..... *E01C 19/4886* (2013.01); *E01C 19/405* (2013.01); *E01C 2301/18* (2013.01)

(58) Field of Classification Search
CPC . E01C 19/405; E01C 19/4886; E01C 2301/18
USPC ..... 404/72, 75, 84.05, 89, 93, 105
See application file for complete search history.

(56) References Cited

U.S. PATENT DOCUMENTS 9,663,905 B2 5/2017 Dahm et al.
9,663,906 B2 5/2017 Dahm et al.
9,689,119 B2 6/2017 Dahm et al.
9,797,099 B2 10/2017 Engels et al.
9,873,991 B2 1/2018 Fritz et al.
9,969,427 B1 5/2018 Engels et al.
2015/0176229 A1* 6/2015 Thieme ..... E01C 19/46 404/75
2016/0177519 A1* 6/2016 Fritz ..... E01C 19/42 404/84.5

OTHER PUBLICATIONS

Wirtgen Instruction Manual SP 90 (357 pages) (2015) (uploaded in 7 parts).
Wirtgen Slipform Pavers SP 90 Model Series USA (36 pages) (2016).

* cited by examiner

*Primary Examiner* — Raymond W Addie
(74) *Attorney, Agent, or Firm* — Lucian Wayne Beavers; Patterson Intellectual Property Law, PC

(57) ABSTRACT

An inset slip form paving apparatus includes a frame having a front and a rear defining a paving direction. At least one left ground engaging support and at least one right ground engaging support support the frame from a ground surface. An inset mold assembly is located below the frame and between the left and right ground engaging supports. An adjustable support assembly supports the mold assembly from the frame so that the mold assembly is adjustable in position in the paving direction relative to the frame between a retracted position and an extended position.

30 Claims, 14 Drawing Sheets

SHIFTABLE MOLD

BACKGROUND OF THE INVENTION

1. Field of the Invention

The present invention relates generally to inset slip form paving apparatus, and particularly to improvements in the manner of mounting a mold assembly below a frame of the slip form paving apparatus.

2. Description of Prior Art

In a traditional inset slip form paving apparatus, such as for example a Wirtgen Model SP94i machine, the mold assembly is suspended below the frame of the slip form paving apparatus. The operator platform is located above the frame of the slip form apparatus, and the operator must look downward through and around the various portions of the frame to observe the paving operation being performed by the mold assembly. It is desirable to improve the visibility of the paving operation for the operator of machines of this type.

In other known types of slip form paving apparatus, the standard operating configuration of the paver has various accessories such as for example the super smoother and/or the spreading plow or spreading auger extending forward or rearward of the main frame of the paver. In those arrangements it may be required to remove various components to reduce the width of the paver for transport on the public highways. It is desirable to improve the adaptability of machines of this type for transport without the inconvenience of removal of such accessories.

SUMMARY OF THE INVENTION

In one embodiment an inset slip form paving apparatus includes a frame having a front and a rear defining a paving direction from the rear toward the front. At least one left ground engaging support and at least one right ground engaging support are configured to support the frame from a ground surface. An inset mold assembly is located below the frame and between the at least one left ground engaging support and the at least one right ground engaging support. An adjustable support assembly supports the mold assembly from the frame so that the mold assembly is adjustable in position in the paving direction relative to the frame between a retracted position and an extended position.

In an embodiment, in the extended position at least a portion of the mold assembly extends forward of the front side of the frame.

In another embodiment, the adjustable support assembly may include at least two linear guides oriented in the paving direction and spaced apart in a widthwise direction perpendicular to the paving direction.

The support assembly may include at least two linear actuators configured to move the mold assembly between its retracted and extended positions.

Each of the linear actuators may include a hydraulic cylinder.

Each of the linear actuators or linear guides may have associated therewith an extension sensor configured to provide a position signal representative of an amount of extension of the respective linear actuator. A controller may be provided and may be configured to receive the position signals from the extension sensors and to provide output signals to the linear actuators such that the linear actuators each extend by the same amount when moving the mold assembly.

The controller may be further configured such that the mold assembly can be located at any position between the retracted position and the extended position.

In another embodiment, a lock may be associated with each of the linear guides. The lock may be configured to lock the mold assembly in a selected position relative to the frame.

Each lock may include a hydraulically actuated member carrying a locking pad.

In another embodiment, each of the linear guides may include an outer tube and an inner tube telescopingly received in the outer tube. Each of the linear actuators may include a hydraulic cylinder received within at least one of the outer tube and the inner tube and connected to both the outer tube and the inner tube for telescoping the outer tube and inner tube relative to each other upon extension or retraction of the hydraulic cylinder.

The outer and inner tubes may each have a four sided cross section.

The mold assembly may include a mold and left and right side plates attached to the mold and extending forward of the mold to define a consolidation area between the side plates and forward of the mold. In the extended position of the mold assembly the consolidation area may extend sufficiently forward relative to the frame so that an operator standing at an operator's station above the frame has a line of sight into the consolidation area to a distance at least half way from a forwardmost extent of the consolidation area to the mold.

In another embodiment, the mold assembly may include a mold, and left and right side plates attached to the mold and extending forward of the mold to define a consolidation area between the side plates and forward of the mold. A mixing auger may be located in the consolidation area closer to the mold than to the forwardmost extent of the consolidation area. When in the extended position of the mold assembly the consolidation area may extend sufficiently forward relative to the frame so that an operator standing at an operator's station above the frame has a line of sight into the consolidation area to a highest point of the mixing auger.

The mold assembly may further include a metering gate located within the consolidation area adjacent the forwardmost extent of the consolidation area and defining a grout box between the mold and the metering gate.

In one embodiment a distance in the paving direction between the retracted position and the extended position of the mold assembly may be in a range of from about 6 inches to about 24 inches.

In another embodiment an inset slip form paving apparatus includes a frame having a front, a rear, a left side and a right side, a paving direction being defined as from the rear toward the front, and a widthwise direction being defined as perpendicular to the pavement direction. The apparatus may include at least one left ground engaging support and at least one right ground engaging support configured to support the frame from a ground surface. An inset mold assembly may be located below the frame and between the at least one left ground engaging support and the at least one right ground engaging support. First and second linear guides may be oriented in the paving direction and spaced apart in the widthwise direction. Each of the linear guides may connect the mold assembly to the frame so that the mold assembly is adjustable in position in the paving direction relative to the frame between a retracted position and an extended position, at least part of the mold assembly extending forward of the front of the frame when the mold assembly is in the extended position. First and second linear actuators may be configured to move the mold assembly between its retracted and extended positions.

In one embodiment the first linear actuator may include a first hydraulic cylinder, a first hydraulic actuator for actuating the first hydraulic cylinder, and a first extension sensor configured to generate a first extension signal representative of an extension of the first hydraulic cylinder. The second linear actuator may include a second hydraulic cylinder, a second hydraulic actuator for actuating the second hydraulic cylinder, and a second extension sensor configured to generate a second extension signal representative of an extension of the second hydraulic cylinder.

A controller may be operably associated with the first and second extension sensors for receiving the first and second extension signals, the controller being configured to generate actuation signals for the first and second hydraulic actuators to control the extension of the first and second hydraulic cylinders in response to the first and second extension signals.

The controller may be configured to extend and retract the first and second hydraulic cylinders together at equal rates so as to prevent binding of the first and second linear guides.

First and second hydraulically actuated locks may be associated with the first and second linear guides, respectively, and configured to lock the mold assembly in any selected position between and including the retracted position and the extended position.

A method is provided for retrofitting an inset slip form paving apparatus having a frame with a front and a rear defining a paving direction from the rear toward the front, at least one left ground engaging support and at least one right ground engaging support configured to support the frame from the ground surface, and an inset mold assembly located below the frame and between the at least one left ground engaging support and the at least one right ground engaging support. The method may include the steps of:

(a) removing the mold assembly from the frame; and (b) installing an adjustable support assembly between the mold assembly and the frame so that the mold assembly is adjustable in position in the paving direction relative to the frame between a first position and a second position.

In another embodiment a method is provided for operating an inset slip form paving apparatus. The paving apparatus may be of the type having a frame with a front and a rear defining a paving direction from the rear toward the front, at least one left ground engaging support and at least one right ground engaging support configured to support the frame from a ground surface, and an inset mold assembly located below the frame and between the at least one left ground engaging support and the at least one right ground engaging support. The method may comprise the steps of:

(a) providing an adjustable support assembly between the mold assembly and the frame so that the mold assembly is adjustable in position in the paving direction relative to the frame between a retracted position and an extended position;

(b) extending the mold assembly to the extended position in which at least part of the mold assembly extends forward of the frame to improve visibility of the mold assembly to an operator located at an operator's station located above the frame;

(c) performing a paving operation with the mold assembly in the extended position;

(d) after step (c), retracting the mold assembly to the retracted position; and (e) with the mold assembly in the retracted position reconfiguring the slip form paving apparatus to a transport configuration wherein the ground engaging supports are configured to move the apparatus in a transport direction perpendicular to the paving direction.

In any of the above embodiments the mold assembly may also include a crown actuator and the crown actuator may be shifted relative to the frame with the mold assembly.

An alternative arrangement for controlling the extension of the mold assembly may include a hydraulic fluid supply and a flow divider between the hydraulic fluid supply and the hydraulic cylinders of the adjustable support assembly. The flow divider may be configured to provide equal hydraulic fluid flows to each of the hydraulic cylinders so that they extend and retract equally Numerous objects, features and advantages of the present invention will be readily apparent to those skilled in the art upon reading of the following disclosure when taken in conjunction with the accompanying drawings.

DETAILED DESCRIPTION

Figure 1:
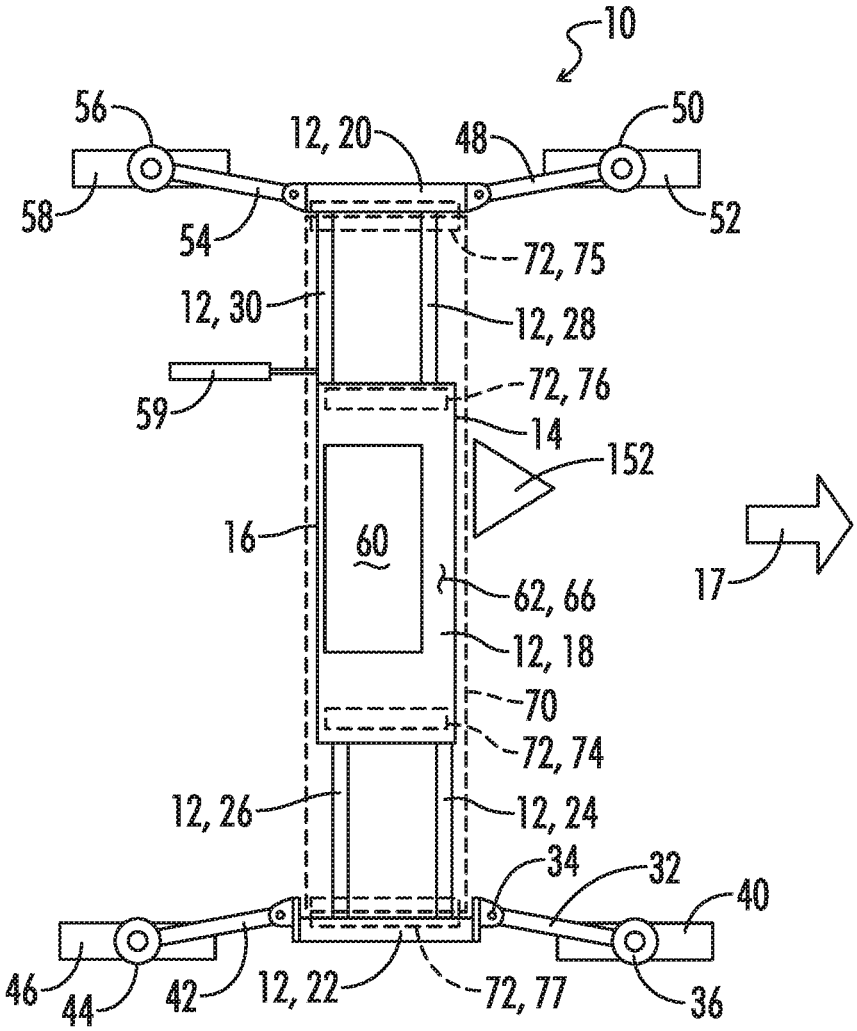
FIG. 1 is a schematic plan view of an inset slip form paving apparatus in the paving configuration.

Referring now to the drawings, and particularly to FIGS. 1 thru 4, an inset slip form paving apparatus is shown and generally designated by the numeral 10. The paving apparatus 10 includes a frame 12 having a front 14 and a rear 16 defining a paving direction 17 from the rear 16 toward the front 14.

In one embodiment the frame 12 may include a central main frame member 18, a left side frame bolster 20 and a right side frame bolster 22. The frame 12 may include forward and rear right side telescoping members 24 and 26, respectively and forward and rear left side telescoping members 28 and 30, respectively.

A right front swing arm 32 may be pivotally connected to right frame bolster 22 at pivot 34, and the outer end of the right front swing arm 32 may be attached to a right front lifting column 36. The right front lifting column 36 may include a telescoping lower tubular member 38 attached to a right front track 40. The track 40 may be generally referred to as a ground engaging support. It will be understood that instead of the tracks 40 wheels or other suitable ground engaging supports may be utilized.

In a similar fashion, a right rear swing arm 42 connects the right side frame bolster 22 to a right rear lifting column 44 and a right rear track 46. A left front swing arm 48 connects the left side frame bolster 20 to a left front lifting column 50 and a left front track 52. A left rear swing arm 54 connects the left side frame bolster to a left rear lifting column 56 and a left rear track 58.

The details of construction of the frame 12, the swing arms, the lifting columns and the tracks may be any conventional construction. The lateral telescoping of the frame 12 may be accomplished using hydraulic cylinders and automated control systems (not shown). The left and right side bolsters 20 and 22 may also be constructed in extendable fashion. Various additional equipment such as a dowel bar inserter (not shown), a super smoother 59, a rotary trimmer (not shown) and the like may be attached to the frame 12.

An engine compartment 60 may be supported from the frame 12 and may provide power for all of the various devices of the paving apparatus 10. The engine compartment 60 may for example include an internal combustion engine driving a plurality of hydraulic pumps for providing hydraulic power to the various hydraulically powered devices described herein.

Also supported from the frame 12 above the main frame portion 18 is an operator's platform 62, where a human operator 64 may stand to operate the paving apparatus 10. The operator's platform 62 may include a walkway 66 in front of the engine compartment 60.

In FIG. 1, the paving apparatus 10 is shown in what is referred to as a paving configuration in which the swing arms are oriented generally forward and aft, and wherein the tracks are aligned generally with the paving direction 17 so that the paving apparatus 10 may move across a ground surface 68 to lay down a molded slab of concrete.

It will be understood that the apparatus 10 may include further powered actuators to control the pivoting motion of the swing arms, and to steer the tracks relative to the swing arms.

Figure 2:
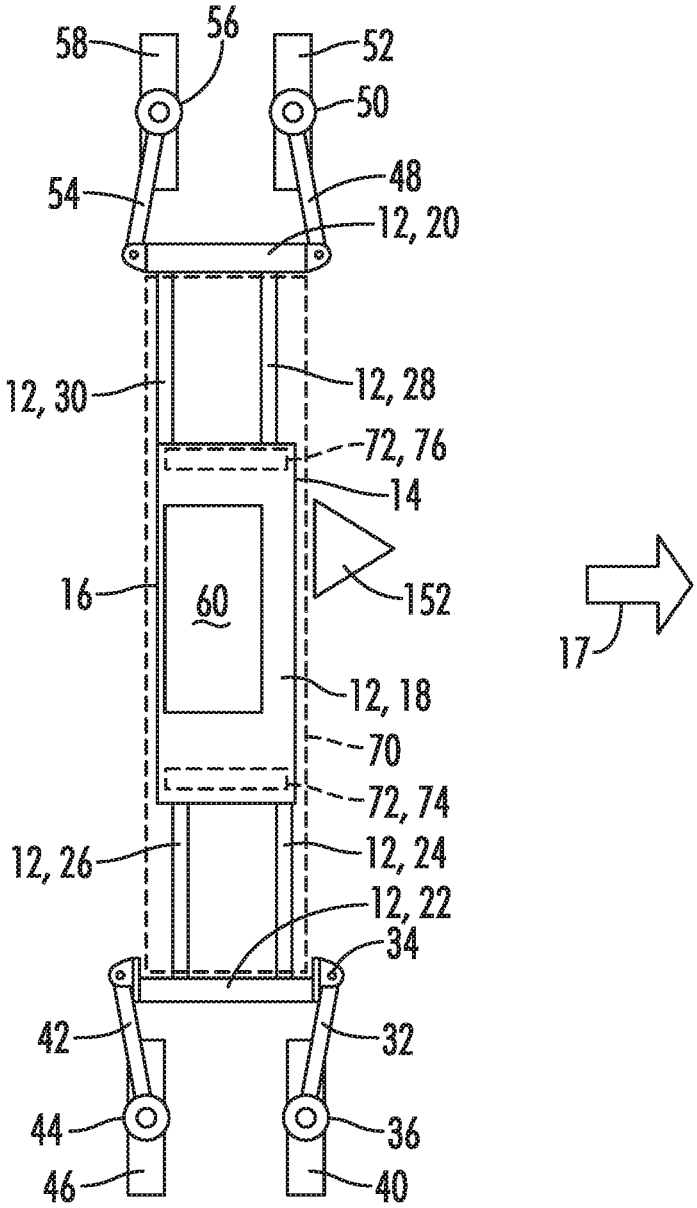
FIG. 2 is a schematic plan view of the inset slip form paving apparatus of FIG. 1, reconfigured into the transport configuration.

As will also be appreciated by those skilled in the art, due to its large dimensions the slip form paving apparatus must be reconfigured from the paving configuration of FIG. 1 into a narrower configuration such as the transport configuration of FIG. 2 in order to transport the apparatus 10 from one paving site to another. To reconfigure the paving apparatus 10 into the transport configuration, the swing arms and tracks are re-oriented as shown so as to provide a relatively long narrow configuration which can be then placed upon a semi-trailer for transport along the public highways. In the transport configuration the paving apparatus 10 must have a transport width within legally permitted limits, for example 9'10" (3000 mm) in the United States, or 2550 mm in Europe.

In FIG. 1, an inset mold assembly 70 is schematically illustrated by the dashed rectangular box as indicated. The inset mold assembly 70 may be generally described as being located below the frame 12 and between the left ground engaging supports or tracks 52, 58 and the right ground engaging supports or tracks 40, 46. In FIG. 1, and in the right side elevation view of FIG. 3, the inset mold assembly 70 is generally indicated as being in its retracted position located immediately below the frame 12. In FIG. 4, the inset mold assembly is shown as being located in its extended position wherein a portion of the mold assembly 70 extends forward of the front 14 of the frame 12. The retracted and extended positions may also be referred to as first and second positions.

Figure 3:
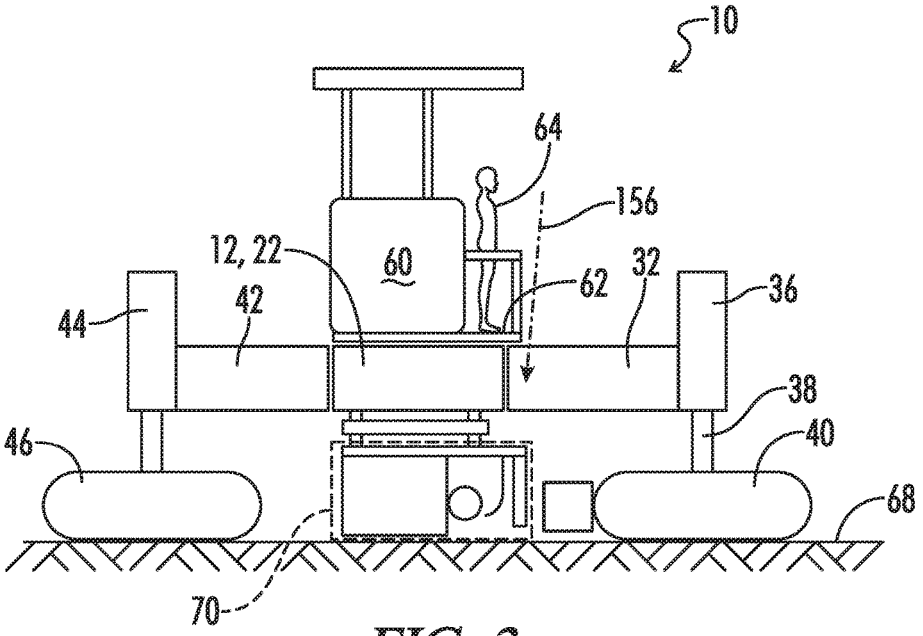
FIG. 3 is a schematic right side elevation view of the paving apparatus of FIG. 1, showing the mold assembly in the retracted position.
Figure 4:
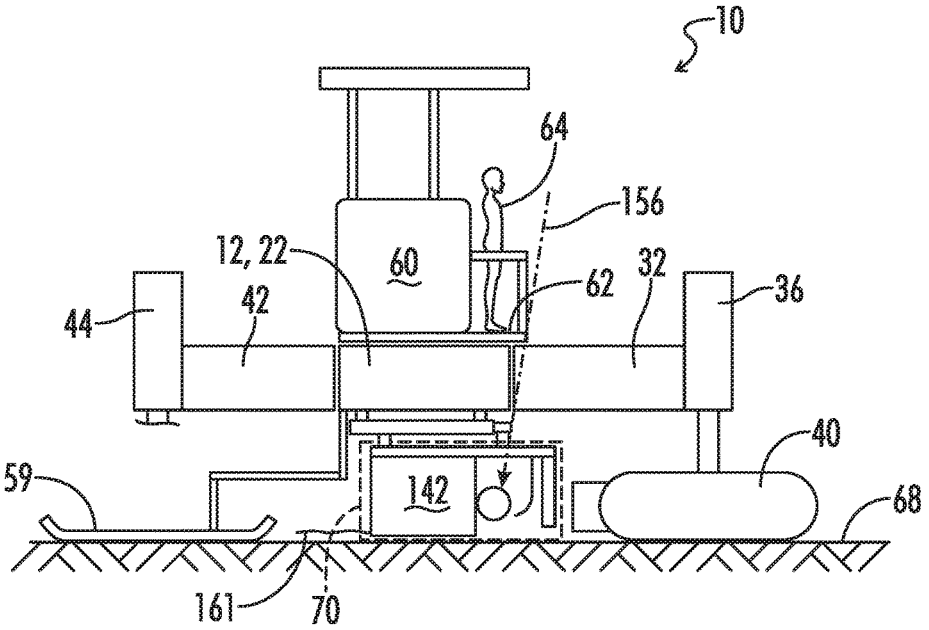
FIG. 4 is a view similar to FIG. 3 showing the mold assembly in the extended position.
Figure 5:
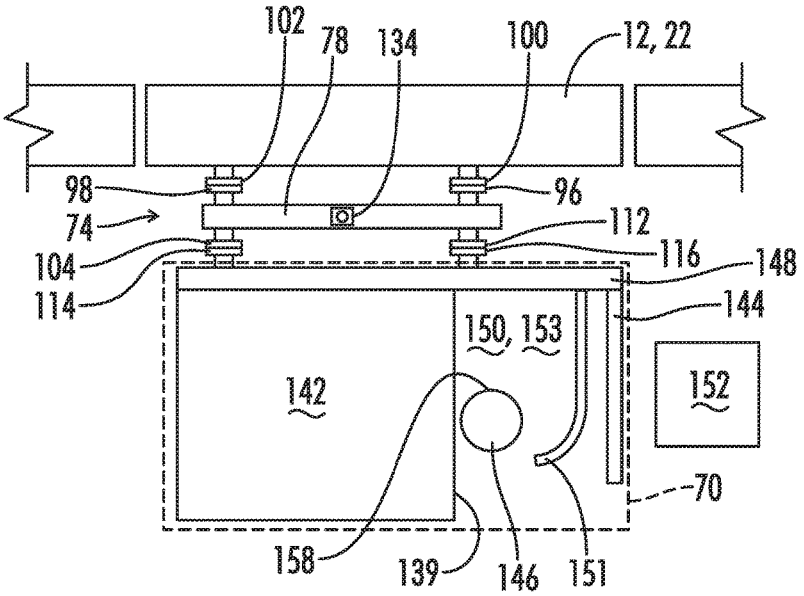
FIG. 5 is an enlarged schematic view of the mold assembly and surrounding frame structure of the apparatus of FIG. 3 with the mold assembly in the retracted position.
Figure 6:
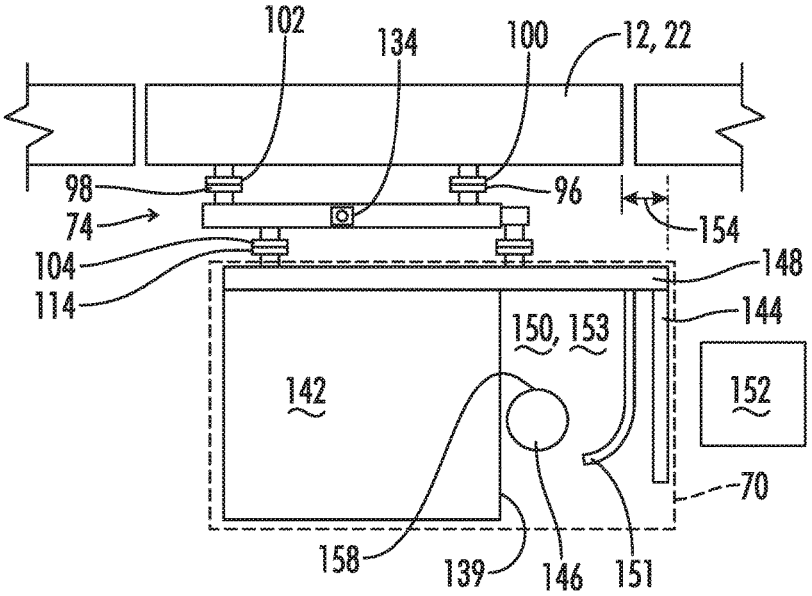
FIG. 6 is a view similar to FIG. 5 showing the mold assembly in the extended position.

The apparatus 10 further includes an adjustable support assembly 72 supporting the mold assembly 70 from the frame 12 so that the mold assembly 70 is adjustable in position in or parallel to the paving direction 17 relative to the frame 12 between the retracted position shown in FIGS. 1, 3 and 5 and the extended position shown in FIGS. 4 and 6. The adjustable support assembly 72 includes at least two linear guides 74 and 76 oriented in the paving direction 17 and spaced apart in a widthwise direction perpendicular to the paving direction as schematically illustrated in FIG. 1. The adjustable support assembly 72 may include more than two linear guides. For example as schematically shown in FIG. 1 the adjustable support assembly may also include third and fourth linear guides 75 and 77.

Linear Guides

Details of construction of the linear guides are shown in FIGS. 7-18. The details of the first linear guide 74 will be described with it being understood that the construction of the other linear guides 75, 76 and 77 is substantially identical.

Figure 7:
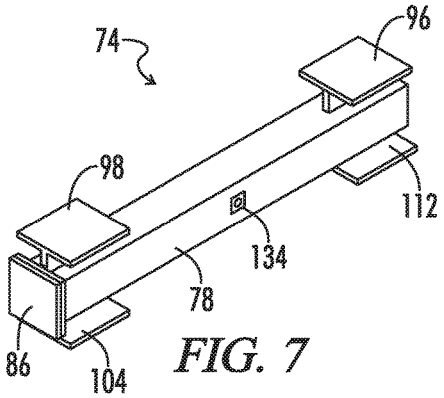
FIG. 7 is a rear right side perspective view from above of one linear guide of an adjustable support assembly in the retracted position.
Figure 8:
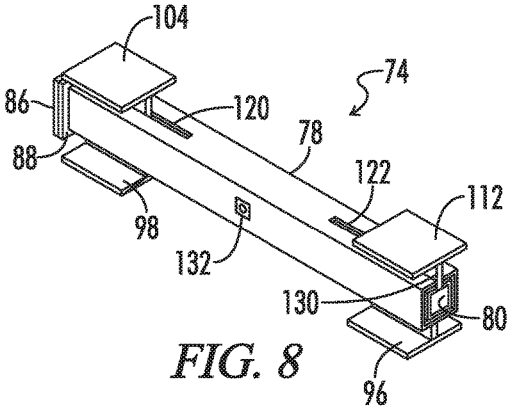
FIG. 8 is a left side front perspective view from below of the linear guide of FIG. 7.
Figure 9:
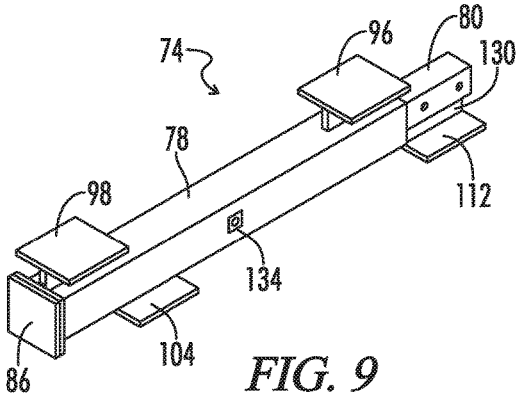
FIG. 9 is a view of the linear guide of FIG. 7 in the extended position.
Figure 10:
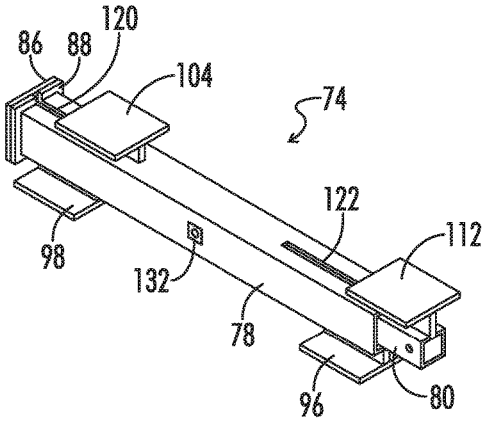
FIG. 10 is a view of the linear guide of FIG. 8 in the extended position.

FIG. 7 is a perspective view of the right side of the first linear guide 74 as viewed from the rear and above. FIG. 8 is a perspective view of the left side of the linear guide 74 as viewed from the front and below. In FIGS. 7 and 8 the linear guide 74 is shown in a retracted position. Similar views of the linear guide 74 are shown in FIGS. 9 and 10 with the linear guide in the extended position.

Figure 11:
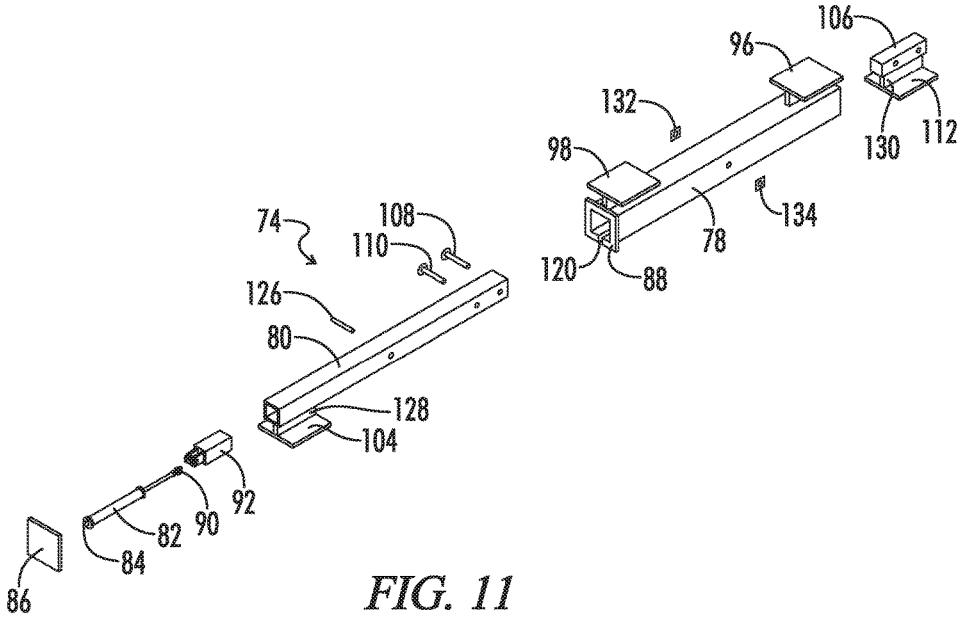
FIG. 11 is a rear right side exploded perspective view from above of the linear guide of FIG. 7.
Figure 12:
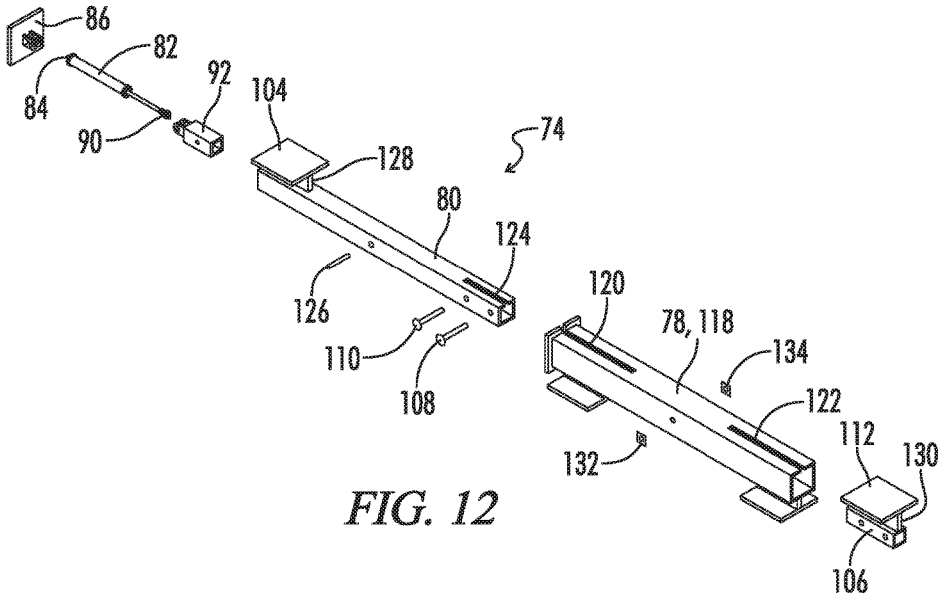
FIG. 12 is front left side exploded perspective view from below of the linear guide of FIG. 8.
Figure 13:
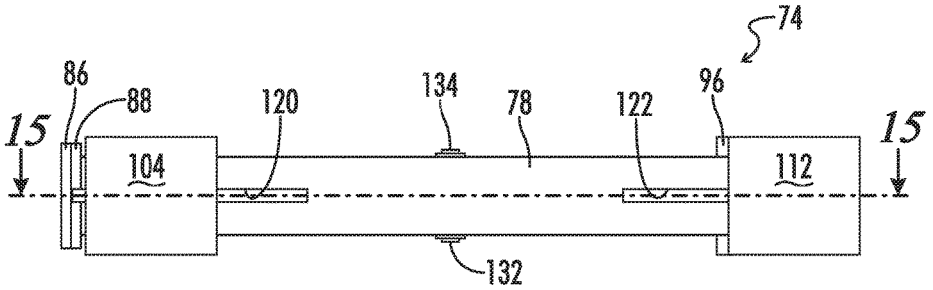
FIG. 13 is an enlarged bottom view of the linear guide of FIG. 7 in the retracted position.
Figure 14:
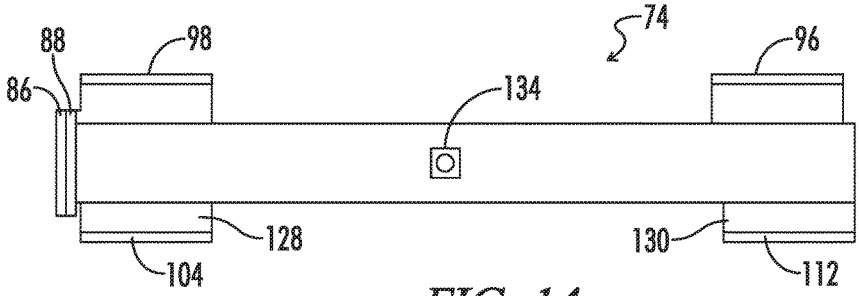
FIG. 14 is a right side elevation view of the linear guide of FIG. 7 in the retracted position.

FIG. 11 shows an exploded view of the linear guide 74 in an orientation similar to that of FIG. 7. FIG. 12 shows an exploded view of the linear guide 74 in an orientation similar to that of FIG. 8.

Figure 15:
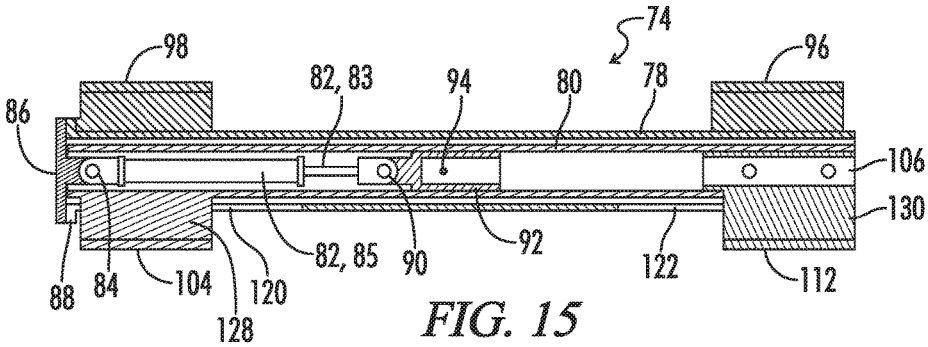
FIG. 15 is a sectioned view of the linear guide of FIG. 13 in the retracted position as taken along line 15-15 of FIG. 13.

The linear guide 74 includes an outer tube 78 and an inner tube 80 telescopingly received in the outer tube 78. A linear actuator 82, which may be a hydraulic cylinder 82 is received within inner tube 80 and the outer tube 78, as best seen in FIGS. 15 and 18. A cylinder end 84 of a cylinder 85 of the hydraulic cylinder 82 is attached to an end plate 86 which is bolted to an end flange 88 of the outer tube 78. A rod end 90 of a rod 83 of hydraulic cylinder 82 is connected to an adapter 92 which is received within the inner tube 80 and attached thereto by a pin or bolt 94 as best seen in FIG. 15.

Figure 15A:
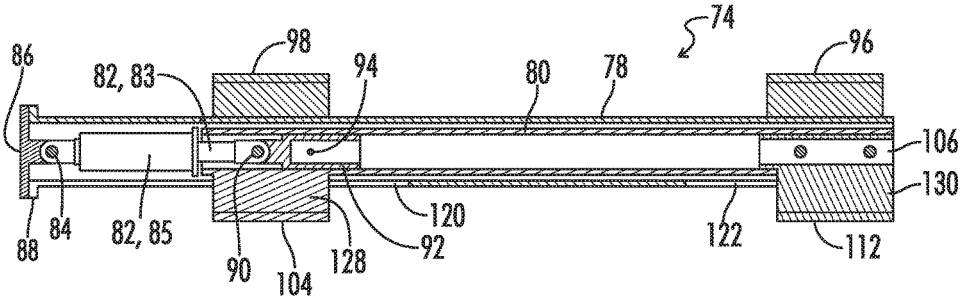
FIG. 15A is a view similar to FIG. 15 of an alternative embodiment of the linear guide having an elongated outer tube.
Figure 18A:
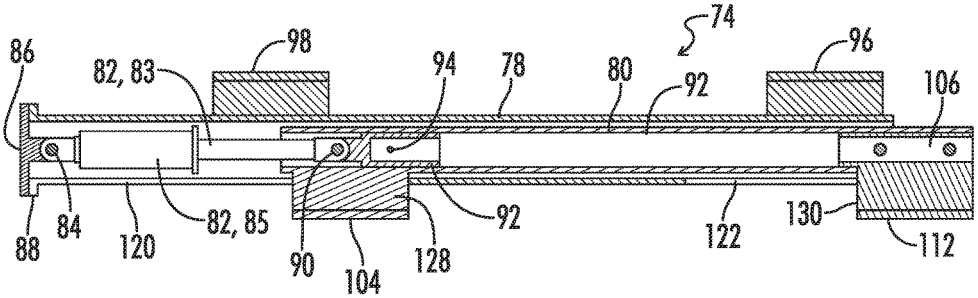
FIG. 18A is a view similar to FIG. 18 of the alternative embodiment of the linear guide having an elongated outer tube.
Figure 16:
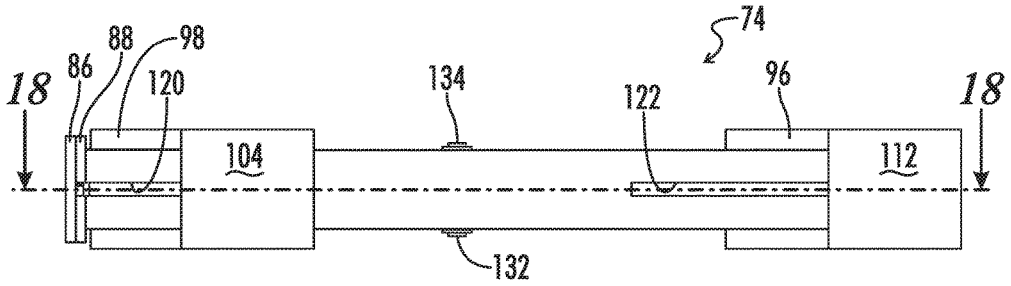
FIG. 16 is a bottom view similar to FIG. 13 but showing the linear guide in the extended position.
Figure 17:
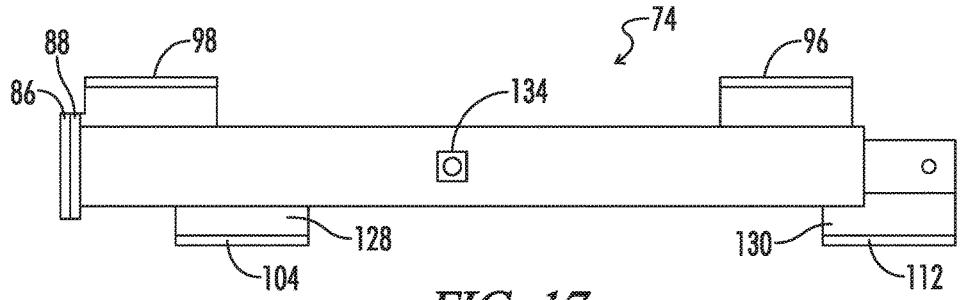
FIG. 17 is a side elevation view similar to FIG. 14 but showing the linear guide in the extended position.
Figure 18:
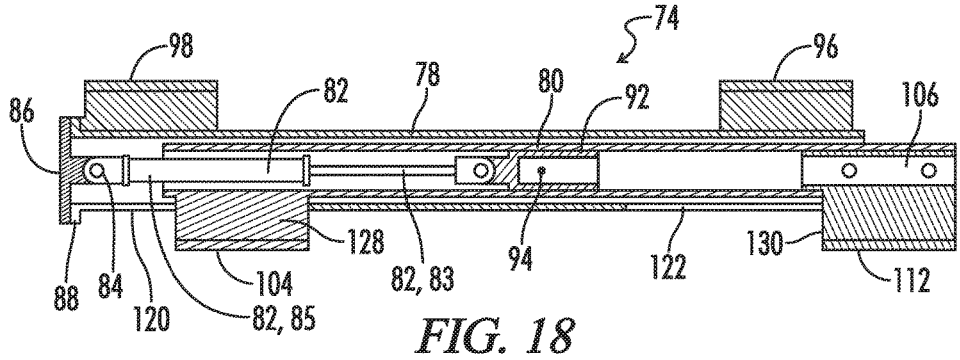
FIG. 18 is a view similar to FIG. 15 but showing the linear guide in the extended position.

FIGS. 15A and 18A are similar to FIGS. 15 and 18, but show a modified linear guide in which the outer tube 78 is lengthened on the rear end so that the cylinder portion 85 of hydraulic cylinder 82 can fit entirely within the outer tube 78 without needing to extend into the inner tube 80. This allows the cylinder 85 to be of larger diameter as compared to the embodiment of FIGS. 15 and 18.

The connection of the hydraulic cylinder 82 to the outer tube 78 and the inner tube 80 and the operation thereof to telescopingly extend and retract the inner tube 80 relative to the outer tube 78 is best understood by comparing FIGS. 15 and 18 showing the retracted and extended positions, respectively.

As best seen in the perspective views like FIGS. 7-12, each of the outer and inner tubes has a four-sided cross section which may for example be a square cross section.

The outer tube 78 has an upper front mounting flange 96 and an upper rear mounting flange 98 fixedly attached thereto. The mounting flanges 96 and 98 are used to attach the linear guide 74 to the frame 12 by bolting the same to complementary mounting flanges 100 and 102 of frame 12 as schematically illustrated in FIGS. 5 and 6.

The inner tube 80 has a lower rear mounting flange 104 attached adjacent its rear end. A front end portion of the inner tube 80 receives an inner bar 106 therein which is bolted to the inner tube 80 by first and second bolts or pins 108 and 110 schematically illustrated in FIG. 11 which are received thru complementary holes through the inner tube 80 and the inner bar 106. A lower front mounting flange 112 extends downward from the inner bar 106.

As schematically illustrated in FIG. 5, the lower rear mounting flange 104 and lower front mounting flange 112 are utilized to attach the linear guide 74 to the inset mold assembly 70 by bolting the same to complementary flanges 114 and 116 which are fixedly attached to the inset mold assembly 70.

The manner of assembly of the linear guide 74 is best understood by viewing the exploded perspective views of FIGS. 11 and 12. As seen in the bottom perspective view of FIG. 12, a lower wall 118 of outer tube 78 has a rearward slot 120 and a forward slot 122 defined therein. The inner tube 80 has a forward slot 124 defined in its lower wall.

First, the hydraulic cylinder 82 may be connected to the adapter 90. Then the adapter 90 and hydraulic cylinder 72 may be inserted into the inner tube 80 and the adapter 90 may be attached to the inner tube 80 by pin or bolt 126.

Then, the assembled hydraulic cylinder 82 and inner tube 80 may slide into the outer tube 78, and a vertical web 128 of lower rear mounting flange 104 may be received in slot 120 of outer tube 78. The inner tube 80 is extended forward so that it extends out of the forward end of outer tube 78. The inner bar 106 may then slide into the forward end of inner tube 80 with a vertical web 130 of lower front mounting flange 112 being received in slot 124. The inner bar 106 may then be attached to inner tube 80 with pins or bolts 108 and 110.

Then the assembled inner tube 80 and inner bar 106 may slide rearward so that the vertical web 130 is received in the slot 122 of outer tube 78.

Finally the cylinder end 84 of hydraulic cylinder 82 may be connected to the end plate 86 and then the end plate 86 may be bolted to the rear flange 88 of outer tube 78 so as to provide the assembled linear guide 74 as best seen in the cross sectional retracted and extended positions of FIGS. 15 and 18.

Figure 20:
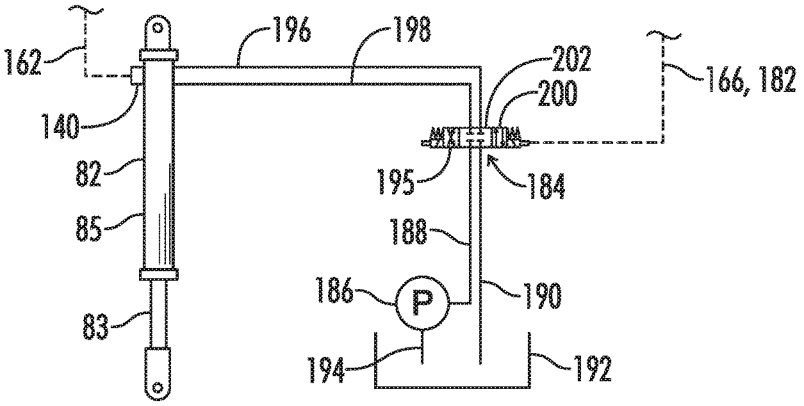
FIG. 20 is a schematic illustration of further details of the control system and the electrical/hydraulic actuator for the hydraulic cylinder of the linear actuator.

Although not shown in FIGS. 15 and 18, appropriate hydraulic lines will be connected to the hydraulic cylinder 82 and routed through the end plate 86 and connected to appropriate hydraulic power sources and hydraulic sumps as is schematically illustrated in FIG. 20.

Also schematically illustrated in FIGS. 7-12 are left and right side locks 132 and 134 associated with the linear guide 74 and configured to lock the mold assembly in a selected position relative to the frame 12. As best illustrated in the schematic view of FIG. 21, each of the locks 132 and 134 includes a hydraulically actuated piston 136 carrying a locking pad 138 on its inner end for engaging a side wall of the inner tube 80 so as to hold the inner tube 80 in a selected position relative to the outer tube 78. Each of the locks 132 and 134 is configured to lock the linear guide 74 and thus the mold assembly 70 in any selected position between and including the retracted and extended positions of the mold assembly 70 shown in FIGS. 5 and 6, respectively.

Figure 19:
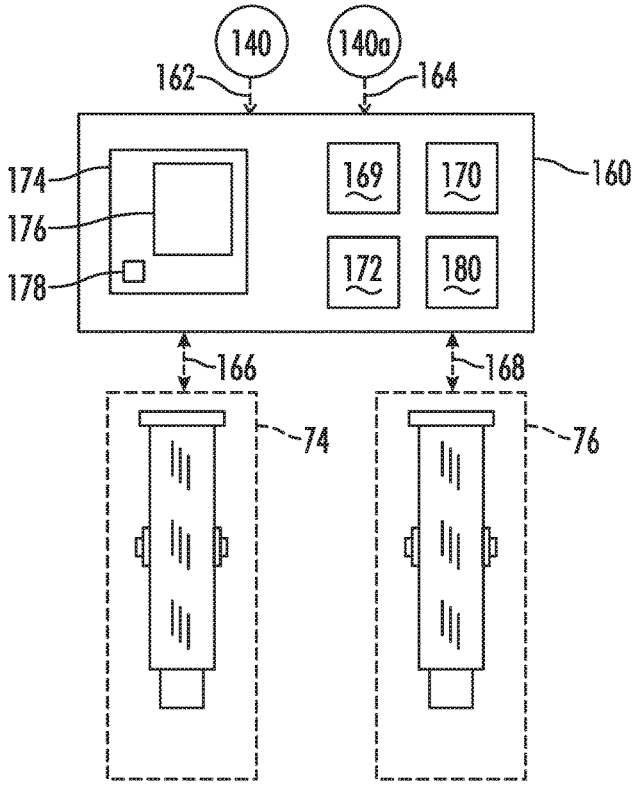
FIG. 19 is a schematic illustration of a control system for the linear actuators and locks of the paving apparatus.

As schematically illustrated in FIG. 20, the hydraulic cylinder 82 may be of the type referred to as a smart cylinder having an integrally constructed extension sensor 140 configured to generate an extension signal representative of an extension of the rod portion 83 of the hydraulic cylinder relative to the cylinder portion 85 thereof. The hydraulic cylinder of the second linear guide 76 may have a similar sensor 140*a* as seen in FIG. 19. Alternatively separate extension sensors may be associated with each of the linear guides 74 and 76. As a further alternative extension sensors may be connected between the frame 12 and the mold assembly 70 at any widthwise spaced locations so as to monitor the movement of the mold assembly 70 relative to the frame 12 at the selected locations.

Mold Assembly

Figure 22:
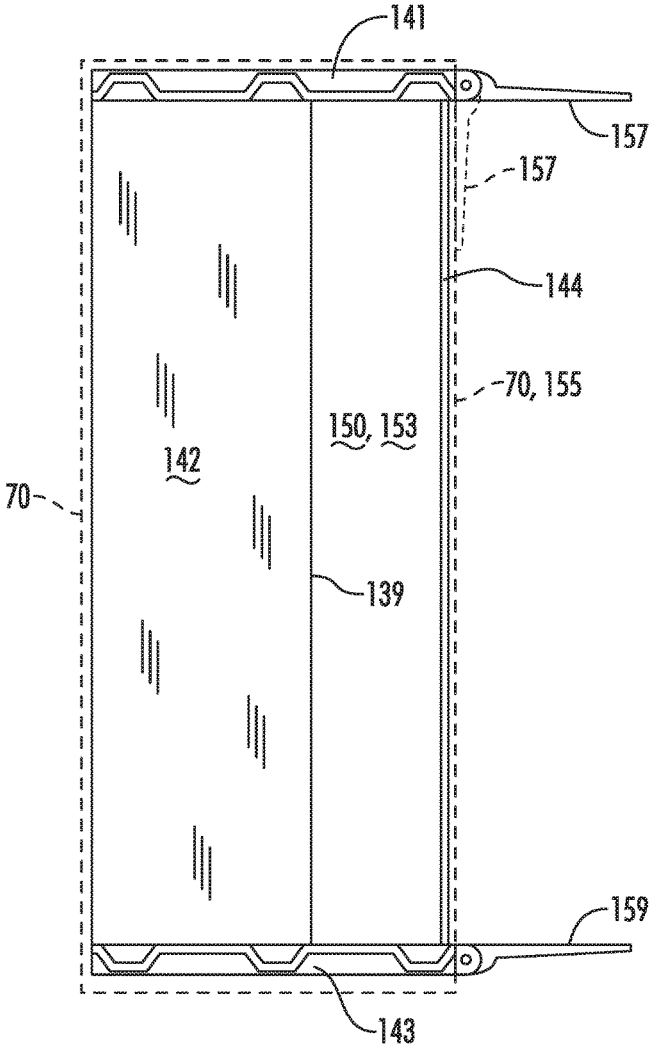
FIG. 22 is a schematic plan view of the mold assembly removed from the frame.
Figure 23:
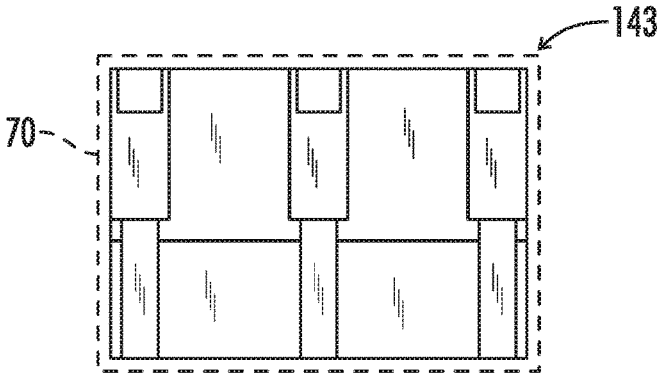
FIG. 23 is a schematic end view of the mold assembly of FIG. 22.

Referring now to FIGS. 5, 6, 22 and 23 the mold assembly schematically illustrated within the dashed box 70 is of conventional construction and may include a mold 142, a vertically movable metering gate 144, and a mixing auger schematically illustrated as 146. The metering gate 144 is optional and may sometimes be omitted. As best seen in FIGS. 22 and 23 the mold assembly may also include left and right vertically adjustable side plates 141 and 143 extending forward of the mold 142 to define a consolidation area 150 between the side plates 141 and 143 and forward of the mold 142. Left and right extension wings 157 and 159 may be pivotably attached to the forward ends of the left and right side plates 141 and 143, respectively. The extension wings 157 and 159 are shown in solid lines in their operating position. The extension wings may be pivoted inward to their transport positions as shown in dashed lines for wing 157. The mold 142 and metering gate 144 may be suspended from a mold assembly frame 148. The portion of the consolidation area 150 between the mold 142 and the metering gate 144 may be referred to as a grout box 153. A row of vibrators 151 may extend into the consolidation area 150. The mold assembly may also include tamper bars (not shown).

The mixing auger 146 is located within the consolidation area 150 and is generally located closer to the mold 142 than it is to either the metering gate 144 or the forwardmost extent 155 of the consolidation area 150.

A spreading device such as plow or spreading auger 152 may be located forward of the consolidation area 150. It will be understood that the spreading device may be supported from the frame 12 or it may be supported from the mold assembly 70. Typically a spreading auger may be supported from the mold assembly 70 and thus the spreading auger will move forward and back with the mold assembly 70. If a spreading plow is used it may be supported directly from the frame 12, in which case it may be necessary to adjust the forward extension of the mounting of the spreading plow to allow for the forward extension movement of the mold assembly 70.

The mold assembly 70 is shown in FIGS. 3 and 5 in its retracted position relative to the frame 12, and the mold assembly 70 is shown in FIGS. 4 and 6 in its extended position relative to the frame 12. The mold assembly 70 is moved between its retracted and extended positions by extension and retraction of the telescoping linear guides 74 and 76 in response to extension and retraction of their associated hydraulic cylinders such as 82. It is noted that although the embodiments illustrated locate the hydraulic cylinders 82 within the linear guides such as 74, it is also possible to locate the hydraulic cylinders separate from the linear guides. And it is not required that there be an identical number of linear guides and hydraulic cylinders. For example, there could be three equally spaced linear guides with two hydraulic cylinders located between adjacent linear guides.

A distance 154 between the retracted position of FIGS. 3 and 5 and the extended position of FIGS. 4 and 6 is schematically illustrated in FIG. 6. In one embodiment the distance 154 may be in a range of from about 6 inches to about 24 inches, and more preferably from about 9 inches to about 18 inches, and most preferably at least about 12 inches.

As is schematically illustrated in FIG. 3, when the mold assembly 70 is in its retracted position and the human operator 64 standing at the operator's platform 62 leans forwards and looks downward to observe the paving operation, a line of sight 156 of the operator 64 is such that it is difficult for the operator 64 to see into the consolidation area 150. However, when the mold assembly 74 is moved forward to its extended position as schematically illustrated in FIGS. 4 and 6, the operator's line of sight 156 is improved relative to the consolidation area 150 so that the operator 64 may better observe the paving operation going on within the consolidation area 150. Preferably, the extension distance 154 is such that when the mold assembly 70 is in its extended position, the forwardmost extent 155 of the consolidation area 150 is located sufficiently forward of the front 14 of frame 12 so that the operator 64 standing at the operator station 62 above the frame 12 has a line of sight 156 into the consolidation area 150 to a distance at least one half way from the forwardmost extent 155 of the consolidation area 150 toward the mold 142, and more preferably the operator can view the front wall 139 of mold 142. Preferably the line of sight 156 when the mold is in its extended position of FIGS. 4 and 6 is such that the operator 64 can view a highest point 158 of the mixing auger 146. By providing the operator 64 such improved visibility into the consolidation area 150 the operator can better control the appropriate level of concrete in the consolidation area 150.

As will be understood by those skilled in the art, during a paving operation a pile of not yet hardened concrete is dumped in front of the mold assembly 70. The concrete may be spread laterally by the plow or spreading auger 152 and then flows under the metering gate 144 (if present) into the consolidation area 150, and then under the mold 142. Typically it is desired to maintain the height of the concrete in the consolidation area 150 no higher than the top of the mixing auger 146.

Another advantage of being able to shift the mold assembly 70 forward to its extended position is that room is then available between mold 142 and super smoother 59 to drag a burlap sheet 161 behind the mold 142 and in front of the super smoother 59 as seen in FIG. 4.

Figure 24:
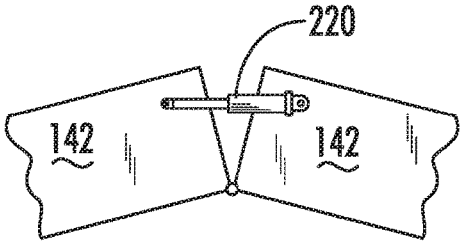
FIG. 24 is a schematic view of a crown mold having a first type of crown actuator.
Figure 25:
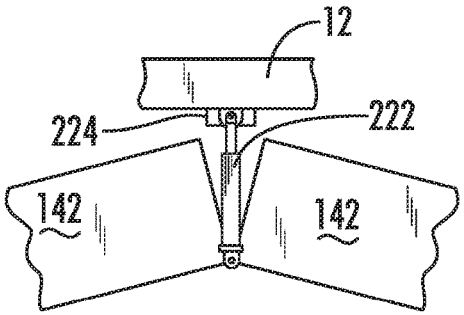
FIG. 25 is a schematic view of a crown mold having a second type of crown actuator.

The mold 142 may be of the type which is hinged in the center so as to provide a crown to the molded slab. Such hinged molds may include a crown actuator to control the crown of the mold. In some embodiments the crown actuator extends between two mold halves as schematically illustrated in FIG. 24. In that instance the crown actuator 220 will move with the mold 142 when the mold 142 is moved forward or rearward relative to the frame 12. In other embodiments such as schematically illustrated in FIG. 25 the crown actuator 222 may be connected between the frame 12 and the mold 142. In the embodiment of FIG. 25 the connection of the crown actuator 222 to the frame 12 may be a sliding connection 224 so that the crown actuator 222 may move forward and rearward with the mold 142 relative to the frame 12.

In addition to improving visibility for the operator into the consolidation area 150 as discussed above, the adjustable support assembly 72 provides the advantage of improved adaptability of the paving machine between its operating and transport configurations. The use of the adjustable support assembly 72 can reduce the amount of removal of accessories which is required in some paver designs to reconfigure the paver for transport.

Controller

A controller 160 schematically illustrated in FIG. 19 receives the input signals from the extension sensors such as 140 and **140*a* and generates control signals to control the extension and retraction of linear guides 74 and 76. Preferably, the controller 160 is configured to receive the position signals from the extension sensors 140 and 140*a* and to provide output signals to the linear actuators 82 of the linear guides 74 and 76 such that the linear actuators 82 of the linear guides 74 and 76 extend by the same amount when moving the mold assembly. It will be understood that when references are made herein to controlling the extension of the linear actuators this refers to both extending and retracting motions of the linear actuators. Due to the large dimensions of the mold assembly 70 which is being extended and retracted, it is desirable to closely control and synchronize the extension of the linear actuators 82 to prevent binding of either of the linear guides 74 and 76 which would impede the extension or retraction motion of the mold assembly 70**.

In FIG. 19, communication of the input signals from extension sensors 140 and **140*a* is indicated by communication lines 162 and 164. Communication of output signals to the linear actuators 82 of the linear guides 74 and 76 from controller 160 is schematically illustrated in FIG. 19 by communication lines 166 and 168**. It will be understood that the communication lines indicated can be hard wired, wireless or any suitable form of communication.

The controller 160 may be part of the machine control system of the slip form paving apparatus 10 or it may be a separate controller. Controller 160 includes a processor 169, a computer readable memory medium 170, a data base 172 and an input/output module or control panel 174 having a display 176. An input/output device 178, such as a keyboard or other user interface, is provided so that the human operator may input instructions to the controller. It is understood that the controller 160 described herein may be a single controller having all of the described functionality, or it may include multiple controllers wherein the described functionality is distributed among the multiple controllers.

The term "computer-readable memory medium" as used herein may refer to any non-transitory medium 170 alone or as one of a plurality of non-transitory memory media 170 within which is embodied a computer program product 180 that includes processor-executable software, instructions or program modules which upon execution may provide data or otherwise cause a computer system to implement subject matter or otherwise operate in a specific manner as further defined herein. It may further be understood that more than one type of memory media may be used in combination to conduct processor-executable software, instructions or program modules from a first memory medium upon which the software, instructions or program modules initially reside to a processor for execution.

"Memory media" as generally used herein may further include without limitation transmission media and/or storage media. "Storage media" may refer in an equivalent manner to volatile and non-volatile, removable and non-removable media, including at least dynamic memory, application specific integrated circuits (ASIC), chip memory devices, optical or magnetic disk memory devices, flash memory devices, or any other medium which may be used to stored data in a processor-accessible manner, and may unless otherwise stated either reside on a single computing platform or be distributed across a plurality of such platforms. "Transmission media" may include any tangible media effective to permit processor-executable software, instructions or program modules residing on the media to be read and executed by a processor, including without limitation wire, cable, fiber-optic and wireless media such as is known in the art.

The term "processor" as used herein may refer to at least general-purpose or specific-purpose processing devices and/or logic as may be understood by one of skill in the art, including but not limited to single- or multithreading processors, central processors, parent processors, graphical processors, media processors, and the like.

More preferably, the controller 160 is configured such that the mold assembly 70 can be located at any position between the retracted position of FIGS. 3 and 5 and the extended position of FIGS. 4 and 6. The locks 132 and 134 previously described associated with each of the linear guides such as linear guide 74 can be activated by the controller 160 via control signals sent over communication lines 166 and 168 to lock the inner tube in position relative to the outer tube at any selected position thereof.

Further, the controller 160 is preferably configured to extend and retract the hydraulic cylinders 82 of the first and second linear guides 74 and 76 together at equal rates so as to prevent binding of the first and second linear guides 74 and 76.

Figure 21:
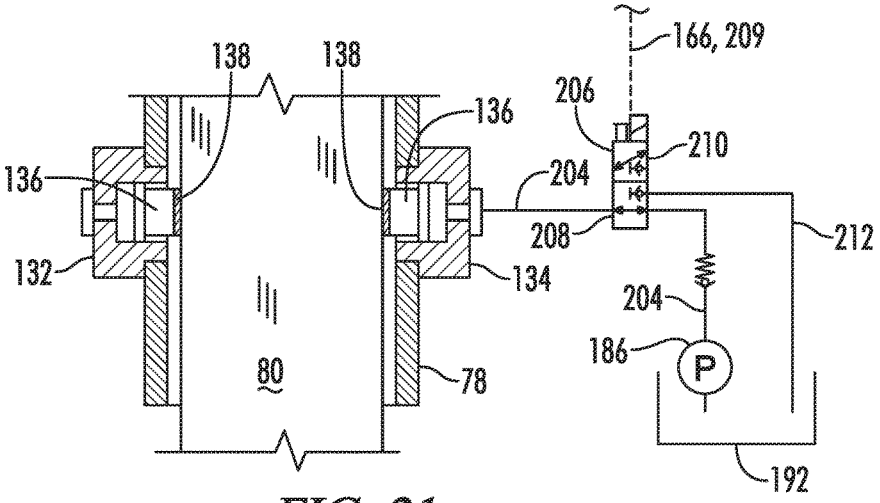
FIG. 21 is a schematic illustration of the hydraulic locks schematically illustrating further details thereof and the electrical/hydraulic actuators therefore.

Further structural details of the manner in which the controller 160 communicates with and controls the operation of the hydraulic cylinders 82 and the hydraulic actuating pistons 136 of locks 132 and 134 are shown in FIGS. 20 and 21.

FIG. 20 shows further details of a representative one of the hydraulic cylinders 82 of the first and second linear guides 74 and 76. As previously noted, the hydraulic cylinder 82 has a cylinder portion 85 with a rod portion 83 extending therefrom. The extension sensor 140 provides the extension signal which is communicated via communication line 162 back to the controller 160.

The incoming communication line 166 is also schematically illustrated, and a specific sub-portion 182 of communication line 166 is schematically noted for carrying the actuation signal to an electric/hydraulic actuator in the form of a three way valve 184 which controls flow of hydraulic fluid to the hydraulic cylinder 82.

Hydraulic fluid under pressure from a pump 186 flows through a hydraulic fluid supply line 188 to the three way valve 184. Return fluid from the three way valve 184 flows through a hydraulic return line 190 to a hydraulic fluid reservoir 192. The pump 186 in turn takes fluid from reservoir 192 through suction line 194.

The three way valve 184 has a first position 195 in which pressurized fluid is directed through line 196 to an upper end of cylinder 82 to extend the rod 83, and in which fluid is received from a lower end of the cylinder 82 via a hydraulic line 198 for return to the reservoir 192. The three way valve 184 can be moved to a second position 200 in which the direction of flow is reversed to retract the rod 83. The three way valve 184 can be moved to a third position 202 wherein flow of hydraulic fluid to and from the hydraulic cylinder 82 is blocked.

Turning now to FIG. 21, a schematic illustration is shown in cross section of a portion of the inner tube 80 received in the outer tube 78, with the two locks 132 and 134 mounted in the outer walls of the outer tube 78 and arranged so that their hydraulic actuating pistons 136 can force their locking pads 138 into engagement with the inner tube 80 to lock the inner tube 80 in place relative to the outer tube 78.

Figure 26:
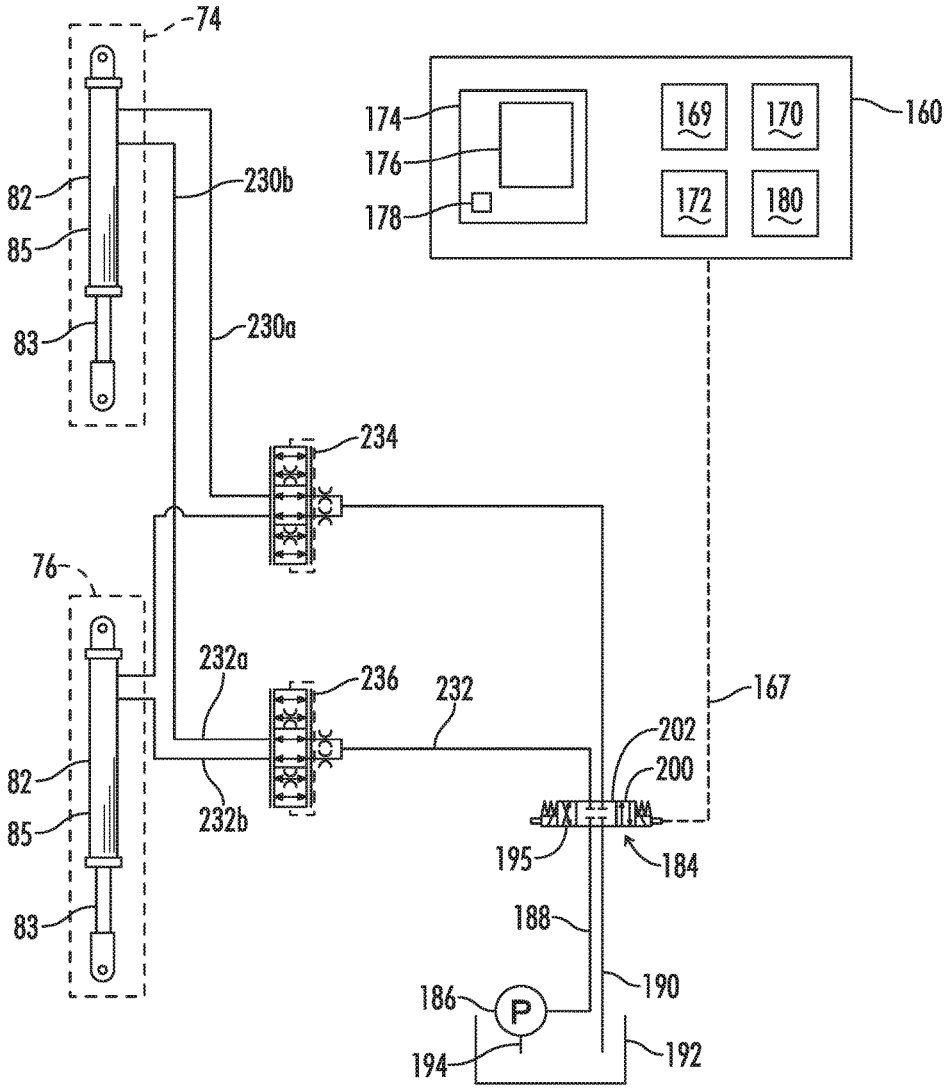
FIG. 26 is a schematic view of an alternative embodiment using flow dividers to insure equal hydraulic flows to the hydraulic cylinders which extend and retract the mold assembly relative to the frame.

In another embodiment as schematically shown in FIG. 26 one or more hydraulic flow dividers may be used to direct equal amounts of hydraulic fluid to the first and second hydraulic cylinders so that the first and second hydraulic cylinders extend and retract together at equal rates so as to prevent binding of the first and second linear guides. In FIG. 26 the controller 160 controls a single three way valve 184 as previously described with control signals sent over communication line 167. The valve 184 directs hydraulic fluid to and from the hydraulic cylinders 82 of first and second linear guides 74 and 76 via first and second hydraulic lines 230 and 232. A first flow divider 234 splits the flow from first hydraulic line 230 into two equal flows directed via hydraulic lines **230*a* and 230*b* to the hydraulic cylinders associated with the first and second linear guides 74 and 76, respectively. A second flow divider 236 splits the flow from second hydraulic line 232 into two equal flows directed via hydraulic lines 232*a* and 232*b* to the hydraulic cylinders associated with the first and second linear guides 74 and 76**, respectively.

Each of the flow dividers 234 and 236 may for example be a spool-type flow divider and combiner that synchronizes hydraulic cylinders 82 of linear guides 74 and 76 in both directions of travel. Each flow divider splits pump flow to the hydraulic cylinders and also assures that equal reverse flow returns from both hydraulic cylinders.

The control system for the locks 132 and 134 is schematically illustrated in FIG. 21. A source of hydraulic pressure such as the previously mentioned pump 186 may provide hydraulic fluid under pressure to lock 134 via hydraulic line 204. A two way control valve 206 is disposed in hydraulic line 204, and is electrically controlled by actuation signals from controller 160 via the communication line 166 and particularly a subpart 209 thereof. The two way control valve 206 has a supply position 208 and a return position 210. When the control valve 206 is moved to the supply position 208 in response to an actuation signal over communication line 166, 209 hydraulic fluid under pressure is directed to the hydraulic lock 134 to move the actuating piston 136 thereof inwardly so that the pad 138 firmly engages the inner tube 80 to lock the same in place. When the control valve is moved to the return position 210, fluid pressure in hydraulic lock 134 is released through return line 212 to the reservoir 192. Similar controls are provided to the other lock 132.

In another embodiment hydraulic flow to and from the hydraulic cylinders 82 may be blocked to lock the mold assembly in any selected position between and including the retracted position and the extended position. This is accomplished, for example, in position 202 of the control valve 200 seen in FIG. 20.

Methods of Operation

It will be appreciated that the mechanisms described above for extension and retraction of the mold assembly 70 are particularly well adapted for retro-fitting of existing inset slip form paving apparatus of the type described. Such existing units may be similar to that described with regard to FIGS. 1-4, except that the mold assembly 70 may be rigidly attached to the frame 12 and may not be movable between extended and retracted positions. To retro-fit such an existing machine, the mold assembly may first be removed from the frame. Then the adjustable support assembly made up of the first and second linear guides 74 and 76 and associated apparatus described above may be installed between the frame 12 and the mold assembly 70 so that the mold assembly 70 is then adjustable in position in the paving direction relative to the frame 12 between the extended and retracted positions as illustrated and described above.

The system described above is also well adapted for use in a method of operating an inset slip form paving apparatus 10 having the frame 12 with the front 14 and rear 16 defining the paving direction 17 from the rear 16 toward the front 14. That paving apparatus 10 has at least one left ground engaging support 52, 58 and at least one right ground engaging support 40, 46 configured to support the frame 12 from the ground surface 68. The inset mold assembly 70 located below the frame 12 and between the left ground engaging supports and the right ground engaging supports is provided. The method may comprise steps of:

(a) providing an adjustable support assembly 72 between the mold assembly 70 and the frame 12 so that the mold assembly is adjustable in position in the paving direction 17 relative to the frame 12 between a retracted position and an extended position;

(b) extending the mold assembly 70 to the extended position in which at least part of the mold assembly extends forward of the frame 12 to improve visibility of the mold assembly 70 to an operator 64 located at an operator's station 62 located above the frame 12;

(c) performing a paving operation with the mold assembly 70 in the extended position;

(d) after step (c), retracting the mold assembly 70 to the retracted position; and (e) with the mold assembly 70 in the retracted position reconfiguring the slip form paving apparatus 10 to a transport configuration as seen in FIG. 2 wherein the ground engaging supports are configured to move the apparatus in a transport direction perpendicular to the paving direction.

Thus it is seen that the methods and apparatus of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. An inset slip form paving apparatus, comprising:

a frame having a front and a rear defining a paving direction from the rear toward the front;

at least one left ground engaging support and at least one right ground engaging support configured to support the frame from a ground surface;

an inset mold assembly located below the frame and between the at least one left ground engaging support and the at least one right ground engaging support; and an adjustable support assembly supporting the mold assembly from the frame so that the mold assembly is adjustable in position parallel to the paving direction relative to the frame between a retracted position and an extended position.

2. The apparatus of claim 1, wherein:

in the extended position at least a portion of the mold assembly extends forward of the front of the frame.

3. The apparatus of claim 1, wherein:

the mold assembly includes a mold and left and right side plates attached to the mold and extending forward of the mold to define a consolidation area between the side plates and forward of the mold; and wherein in the extended position of the mold assembly the consolidation area extends sufficiently forward relative to the frame so that an operator standing at an operator's station above the frame has a line of sight into the consolidation area to a distance at least half way from a forwardmost extent of the consolidation area to the mold.

4. The apparatus of claim 1, wherein:

the mold assembly includes a mold, and left and right side plates attached to the mold and extending forward of the mold defining a consolidation area between the side plates and forward of the mold, and a mixing auger located in the consolidation area closer to the mold than to a forwardmost extent of the consolidation area; and wherein in the extended position of the mold assembly the consolidation area extends sufficiently forward relative to the frame so that an operator standing at an operator's station above the frame has a line of sight into the consolidation area to a highest point of the mixing auger.

5. The apparatus of claim 1, wherein:

a distance in the paving direction between the retracted position and the extended position of the mold assembly is in a range of 6 inches to 24 inches.

6. The apparatus of claim 1, wherein:

the adjustable support assembly includes at least two hydraulic cylinders oriented in the paving direction and spaced apart in a widthwise direction perpendicular to the paving direction, the hydraulic cylinders being connected between the frame and the mold assembly for moving the mold assembly between the extended position and the retracted position relative to the frame; and the apparatus further includes:

a hydraulic fluid supply configured to provide hydraulic fluid under pressure to the hydraulic cylinders; and a hydraulic flow divider between the hydraulic fluid supply and the hydraulic cylinders, the hydraulic flow divider being configured to provide equal hydraulic fluid flows to each of the hydraulic cylinders.

7. The apparatus of claim 1, wherein:

the adjustable support assembly includes at least two linear guides oriented in the paving direction and spaced apart in a widthwise direction perpendicular to the paving direction.

8. The apparatus of claim 7, further comprising:

at least one lock associated with each of the linear guides and configured to lock the mold assembly in any selected position between and including the retracted position and the extended position.

9. The apparatus of claim 8, wherein each lock includes a hydraulically actuated member carrying a locking pad.

10. The apparatus of claim 7 wherein:

the adjustable support assembly includes at least two linear actuators configured to move the mold assembly between its retracted and extended positions.

11. The apparatus of claim 10, wherein each of the linear actuators includes a hydraulic cylinder.

12. The apparatus of claim 10, further comprising:

at least two extension sensors spaced apart in the widthwise direction, each extension sensor being configured to provide a position signal representative of an amount of movement in the paving direction of the mold assembly relative to the frame; and a controller configured to receive the position signals from the extension sensors and to provide output signals to the linear actuators such that the linear actuators extend by the same amount when moving the mold assembly.

13. The apparatus of claim 10, wherein:

each of the linear guides includes an outer tube and an inner tube telescopingly received in the outer tube; and each of the linear actuators includes a hydraulic cylinder received within at least one of the outer tube and the inner tube and connected to both the outer tube and the inner tube for telescoping the outer tube and inner tube relative to each other upon extension or retraction of the hydraulic cylinder.

14. The apparatus of claim 13 wherein each of the outer and inner tubes has a four sided cross-section.

15. The apparatus of claim 12, wherein the controller is configured such that the mold assembly can be located at any position between the retracted position and the extended position.

16. The apparatus of claim 12, further comprising:

at least one lock associated with each of the linear guides and configured to lock the mold assembly in a selected position relative to the frame.

17. The apparatus of claim 12, wherein each of the extension sensors is associated with a respective one of the linear guides.

18. The apparatus of claim 12, wherein each of the extension sensors is associated with a respective one of the linear actuators.

19. An inset slip form paving apparatus, comprising:

a frame having a front, a rear, a left side and a right side, a paving direction being defined as from the rear toward the front, and a widthwise direction being defined as perpendicular to the paving direction;

at least one left ground engaging support and at least one right ground engaging support configured to support the frame from a ground surface;

an inset mold assembly located below the frame and between the at least one left ground engaging support and the at least one right ground engaging support;

first and second linear guides oriented in the paving direction and spaced apart in the widthwise direction, each of the linear guides connecting the mold assembly to the frame so that the mold assembly is adjustable in position parallel to the paving direction relative to the frame between a retracted position and an extended position, at least part of the mold assembly extending forward of the front of the frame when the mold assembly is in the extended position; and first and second linear actuators configured to move the mold assembly between its retracted and extended positions.

20. The apparatus of claim 19, further comprising:

first and second hydraulically actuated locks associated with the first and second linear guides, respectively, and configured to lock the mold assembly in any selected position between and including the retracted position and the extended position.

21. The apparatus of claim 19, wherein:

the first linear actuator includes a first hydraulic cylinder, a first hydraulic valve for actuating the first hydraulic cylinder, and a first extension sensor configured to generate a first extension signal representative of an extension of the first hydraulic cylinder; and the second linear actuator includes a second hydraulic cylinder, a second hydraulic valve for actuating the second hydraulic cylinder, and a second extension sensor configured to generate a second extension signal representative of an extension of the second hydraulic cylinder.

22. The apparatus of claim 21, further comprising:

a controller operably associated with the first and second extension sensors for receiving the first and second extension signals, the controller being configured to generate actuation signals for the first and second hydraulic valves to control the extension of the first and second hydraulic cylinders in response to the first and second extension signals.

23. The apparatus of claim 22, wherein:

the controller is configured to extend and retract the first and second hydraulic cylinders together at equal rates so as to prevent binding of the first and second linear guides.

24. A method of retrofitting an inset slip form paving apparatus having a frame with a front and a rear defining a paving direction from the rear toward the front, at least one left ground engaging support and at least one right ground engaging support configured to support the frame from a ground surface, and an inset mold assembly located below the frame and between the at least one left ground engaging support and the at least one right ground engaging support, the method comprising steps of:

removing the mold assembly from the frame; and installing an adjustable support assembly between the mold assembly and the frame so that the mold assembly is adjustable in position parallel to the paving direction relative to the frame between a first position and a second position.

25. A method of operating an inset slip form paving apparatus having a frame with a front and a rear defining a paving direction from the rear toward the front, at least one left ground engaging support and at least one right ground engaging support configured to support the frame from a ground surface, and an inset mold assembly located below the frame and between the at least one left ground engaging support and the at least one right ground engaging support, the method comprising steps of:

(a) providing an adjustable support assembly between the mold assembly and the frame so that the mold assembly is adjustable in position parallel to the paving direction relative to the frame between a retracted position and an extended position;

(b) extending the mold assembly to the extended position in which at least part of the mold assembly extends forward of the frame to improve visibility of the mold assembly to an operator located at an operator's station located above the frame;

(c) performing a paving operation with the mold assembly in the extended position;

(d) after step (c), retracting the mold assembly to the retracted position; and (e) with the mold assembly in the retracted position reconfiguring the slip form paving apparatus to a transport configuration wherein the ground engaging supports are configured to move the apparatus in a transport direction perpendicular to the paving direction.

26. The method of claim 25, wherein:

the adjustable support assembly includes at least two linear actuators configured to move the mold assembly between its retracted and extended positions;

further comprising:

during step (b), providing position signals representative of an amount of movement in the paving direction of the mold assembly relative to the frame, the position signals being provided from at least two extension sensors spaced apart in a widthwise direction; and receiving the position signals with a controller and providing output signals from the controller to the linear actuators such that the linear actuators extend by the same amount when moving the mold assembly.

27. The method of claim 25, further comprising:

locking the mold assembly in a selected position relative to the frame.

28. The method of claim 25, wherein:

the mold assembly includes a mold and left and right side plates attached to the mold and extending forward of the mold to define a consolidation area between the side plates and forward of the mold; and wherein in the extended position of the mold assembly the consolidation area extends sufficiently forward relative to the frame so that the operator standing at the operator's station above the frame has a line of sight into the consolidation area to a distance at least half way from a forwardmost extent of the consolidation area to the mold.

29. The method of claim 25, wherein:

the mold assembly includes a mold, and left and right side plates attached to the mold and extending forward of the mold defining a consolidation area between the side plates and forward of the mold, and a mixing auger located in the consolidation area closer to the mold than to a forwardmost extent of the consolidation area; and wherein in the extended position of the mold assembly the consolidation area extends sufficiently forward relative to the frame so that the operator standing at the operator's station above the frame has a line of sight into the consolidation area to a highest point of the mixing auger.

30. The method of claim 25, wherein:

step (b) further comprises extending the mold assembly in a range of 6 inches to 24 inches.

* * * * *